United States Patent [19]

Horwitt

[11] 4,184,351

[45] Jan. 22, 1980

[54] HIGH-PRODUCTION METHOD AND APPARATUS FOR MAKING GROOVED RESISTANCE RIBBON FOR ELECTRICAL HEATING COILS

[75] Inventor: Laurence G. Horwitt, New Haven, Conn.

[73] Assignee: Sun Chemical Corporation, New York, N.Y.

[21] Appl. No.: 908,098

[22] Filed: May 22, 1978

[51] Int. Cl.[2] ..... B21D 17/04

[52] U.S. Cl. ..... 72/132; 72/186; 72/196

[58] Field of Search ..... 72/129, 130, 132, 166, 72/182, 186, 185, 196, 197, 203

[56] References Cited

U.S. PATENT DOCUMENTS

| | | | |
|---|---|---|---|
| 255,958 | 4/1882 | Evans | 72/196 |
| 547,750 | 10/1895 | Clennam | 72/129 |
| 965,311 | 7/1910 | MacMurray | 72/129 |
| 966,916 | 8/1910 | Higgin | 72/129 |
| 1,927,791 | 9/1933 | Balfe | 72/186 |
| 2,083,370 | 6/1937 | Greulich | 72/186 |
| 3,446,049 | 5/1969 | Greis | 72/186 |
| 3,575,027 | 4/1971 | Eisler | 72/186 |
| 3,896,650 | 7/1975 | O'Konski | 72/86 |

FOREIGN PATENT DOCUMENTS

| | | | |
|---|---|---|---|
| 1195578 | 6/1965 | Fed. Rep. of Germany | 72/185 |

*Primary Examiner*—Ervin M. Combs
*Attorney, Agent, or Firm*—Cynthia Berlow

[57] ABSTRACT

A high production method and apparatus by which flat, ribbon-like resistance wire stock is fed between male and female die rolls to produce ribbed or grooved strips which can be spiral wound into electrical heating coils of the type used in cigar lighters, ignitor plugs and the like. The ribbing or grooving of the ribbon enables the nesting of adjoining convolutions to be had. The imparting of the ribbed configuration to the ribbon is effected prior to the cutting and winding of the same into the spiral coil. In accomplishing this, cooperable male and female rolls, turning in opposite directions, engage opposite sides of, and rib the ribbon and thereafter cut it into lengths while it is still moving, this being done at a high production rate. After an annealing process, the cut strips of ribbon can be fed to a coiling machine which will coil them into a spiral shape. The feeding, confining, grooving and cutting procedures are automatically, sequentially and continuously carried out quickly and expeditiously.

18 Claims, 22 Drawing Figures

10
11
12
13
16
17
18
19
20
23
26
30
31
32
33
35
39
55
56
57

HIGH-PRODUCTION METHOD AND APPARATUS FOR MAKING GROOVED RESISTANCE RIBBON FOR ELECTRICAL HEATING COILS

CROSS REFERENCES TO RELATED APPLICATIONS

Copending application of Laurence G. Horwitt entitled High-Production Method and Apparatus For Making Spiral Convolution Electrical Heating Coils, Ser. No. 919,397, filed June 26, 1978.

BACKGROUND

This invention relates to flat resistance wire or ribbon material as used in electric heating coils for cigar lighters and ignitor plugs, and more particularly to a high production method and apparatus by which ribbed or grooved strips are made, suitable for the manufacture of spiral heating coils characterized by nestable convolutions.

For quite a number of years, the heating coils of electric cigar lighters as used in automobiles were wound of flat, ribbon-like resistance wire into a spiral coil shape, utilizing an arbor and related fixtures, in a relatively slow speed process involving appreciable hand labor and handling. As so produced, the heating elements were somewhat costly and in many cases lacked uniformity, being not of especially high quality. Such heating elements were utilized with 6-volt electrical systems of automobiles, for the most part. When automobile electrical systems were improved by changing to 12-volt batteries it became necessary to use a greater length of thinner resistance-wire ribbon in the cigar lighters so as to accommodate these to the higher voltage. In so doing, the spiral-wound heating elements were found to be much less sturdy and rugged, and many instances occured where the coil convolutions became deformed, rendering the cigar lighter inoperative.

In order to remedy this condition, efforts were made to produce spiral-wound heating coils where a ribbed or angular cross-sectional configuration was imparted to the ribbon, so as to cause nesting of adjoining convolutions of the spiral coil and provide greater rigidity and mutual support. This resulted in an improved, sturdier and more rugged coil, and eliminated to a great extent the prior coil failures and burn-outs. The ribbing of the ribbon was done by placing previously cut lengths in a flat die of a press, and applying a punch to the ribbon to form the groove-like configuration. This particular procedure was not only lengthy and costly, but it also produced a high percentage of rejects. Thus, while a solution to one problem was had, there arose other problems which tended to detract from the advantages of forming the ribbon.

SUMMARY

The above drawbacks and disadvantages which are attendant the transverse forming or ribbing of heating coil wire, and particularly wire or ribbon adapted, when coiled, to enable adjoining convolutions to nest with each other, are obviated by the present invention, which has for one object the provision of an improved method and apparatus for producing ribbed or grooved ribbon in strip form, as used in spiral-wound, close-convolution heating elements, to the end that a high rate of manufacturing production can be achieved.

Another object of the invention is to provide an improved method and apparatus for producing ribbed or grooved wire or ribbon for electric heating coils as above set forth, wherein only a very small percentage of rejects due to faulty fabrication occurs, thereby resulting in a desirable economy of manufacture.

Yet another object of the invention is to provide an improved method and apparatus for producing ribbed or grooved resistance wire strips for electric heating coils in accordance with the foregoing, which is relatively simple and foolproof, thereby minimizing the amount of capital expenditure which is required.

A feature of the invention resides in the provision of an improved apparatus as above characterized, which operates economically and requires a minimum amount of maintenance.

Another feature of the invention resides in the provision of an improved high-production grooved-strip making apparatus which is relatively small and compact, requiring but little space and also a minimum of power.

Still other features and advantages will hereinafter appear.

In accomplishing the above objects the invention provides an apparatus and method wherein flat ribbon-like resistance wire stock is fed from a supply spool, between a pair of cooperable male and female rolls which have peripheral configurations that are adapted to impart a particular ribbed or grooved cross-sectional shape to the ribbon, such rolls also carrying tool bits which automatically cut the ribbon into predetermined lengths. Thereafter, the formed and cut lengths of ribbon, if they have work-hardened, can be annealed in a furnace at high temperature in preparation for future coiling.

The female roll, in the embodiment of the invention illustrated herein, is shaped to provide support for the ribbon at spaced-apart areas adjacent the longitudinal edges, as the ribbon passes between the rolls. On the other hand, the male die roll has a shape to impart force to central, longitudinal portions of the ribbon during its passage. Additionally, the female roll has guide shoulders which centralize the ribbon therebetween and insure uniformity in the ribbing or grooving process. Each roll is discontinuous, carrying cooperable tool bits in peripheral cuts or notches, by which the formed ribbon is also cut into predetermined lengths while still experiencing movement. The turning of the rolls is synchronized by suitable gearing.

The severing or cutting of the ribbon, in the illustrated embodiment of the invention, is accomplished by blanking out a short length thereof, and such blanking-out is effected once for each revolution of the die roll.

Also, the imparting of force by the male die roll is withheld during a small fraction of a revolution of the rolls, and the severing of the ribbon occurs after a cessation in the imparting of the force to the ribbon and prior to a restoration of the imparting of said force. A knock-out pin is operative to eject the blanked-out portion of the ribbon from the severing area, each time that the ribbon is cut through.

Other objectives and concepts of the invention will hereinafter appear.

Figure 1:
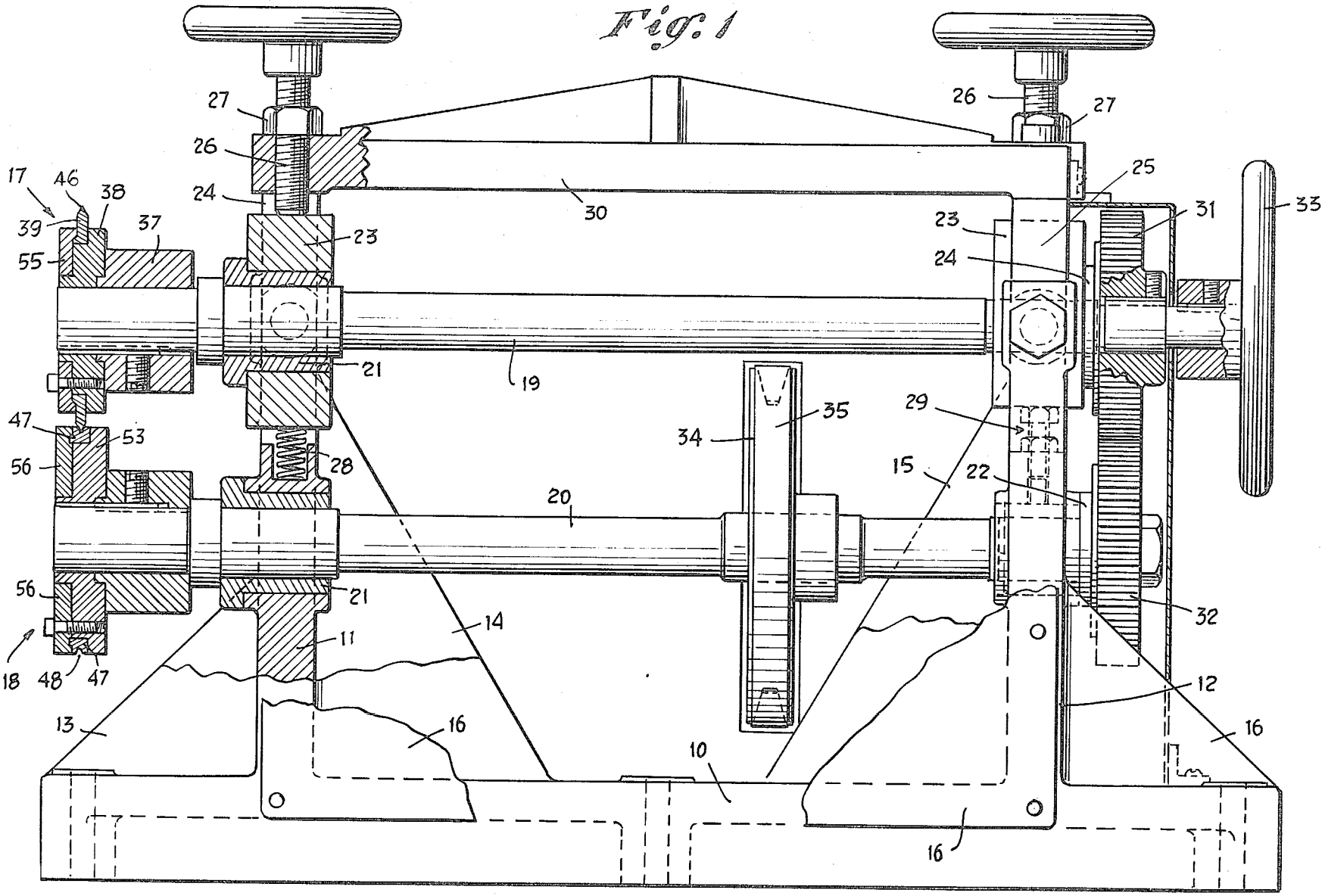
FIG. 1 is a front elevational view of an apparatus which carries out the method of the invention, such apparatus effecting the ribbing or grooving of flat resistance wire or ribbon as provided by the invention.
Figure 2:
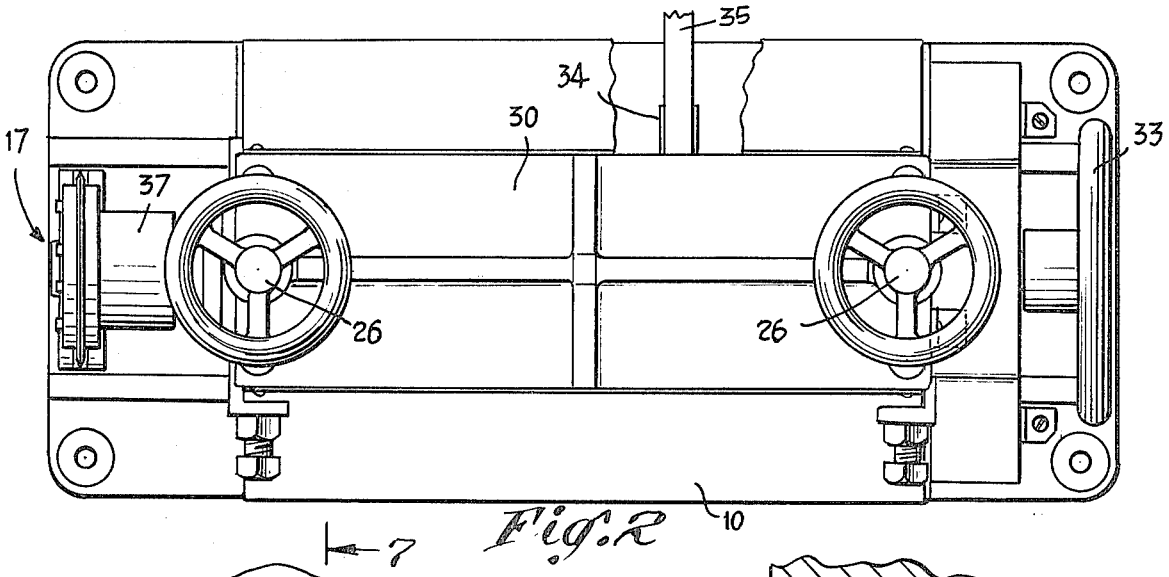
FIG. 2 is a top plan view of the apparatus of FIG. 1.
Figures 3, 4, 5:
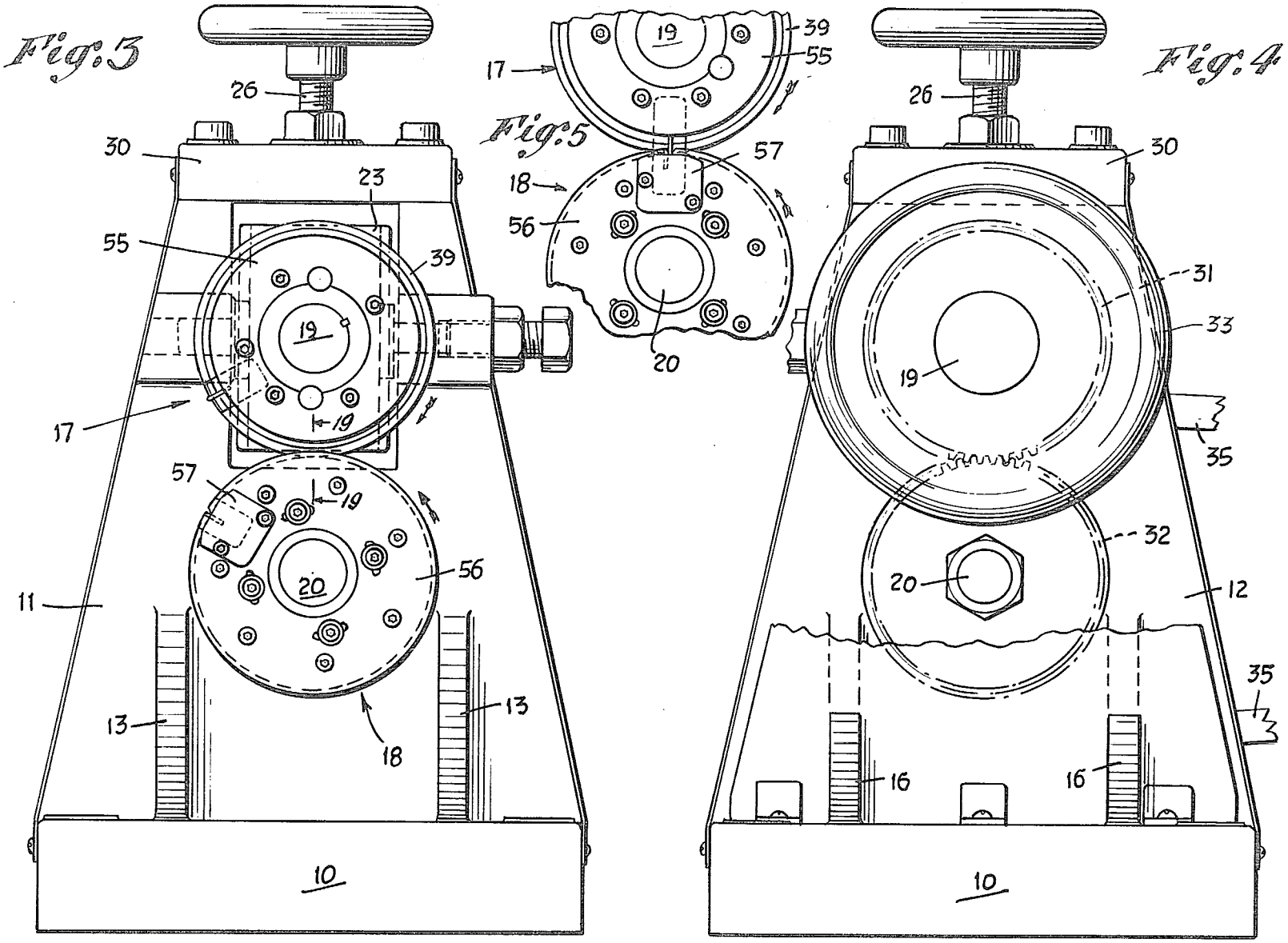
FIG. 3 is a left end elevational view of the apparatus, with male and female die rolls being shown in their grooving positions.
FIG. 4 is a right end elevational view of the apparatus.
FIG. 5 is a fragmentary left end elevational view of the male and female die rolls, shown in their ribbon-severing positions.
Figure 8:
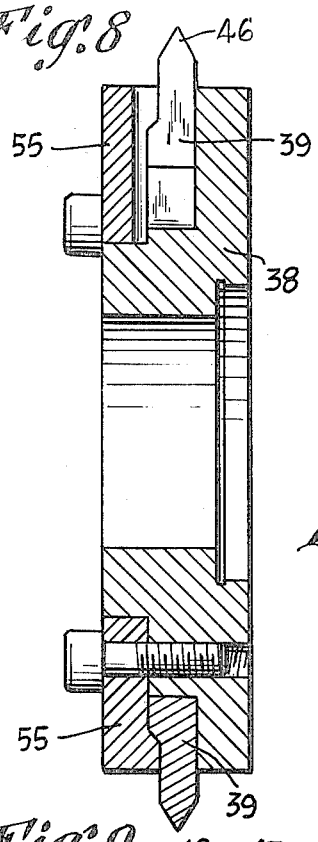
FIG. 8 is a vertical diametric section through the male die roll, in a position rotated 180° from that of FIGS. 5 and 6.

Referring first to FIGS. 1-3, the apparatus illustrated therein comprises a heavy cast metal base 10 having a pair of integral uprights or stanchions 11, 12 which are braced or reinforced by integral cast webs 13, 14 and 15. The apparatus can have a front cover plate 16, which is shown mostly broken away in FIG. 1.

At the left end of the apparatus, as viewed in FIG. 1, there are mounted male and female die roll assemblages 17 and 18 respectively, said assemblages being carried by shafts 19 and 20 which are turnably mounted in bearings 21 and 22 carried by the stanchions 11 and 12. The bearings 21 are disposed in slide blocks 23 which are vertically movable in guides 24, 25 of the stanchions, being adjustable by means of hand screws 26 having lock nuts 27. The slide block 23 in the stanchion 11 is biased upwardly by a compression coil spring 28, and the upper slide block 23 in the stanchion 12 is adjustable upwardly by a screw and nut assemblage 29 cooperating with the associated hand screw 26.

Bridging the stanchions 11 and 12 at the top is a girder 30, which provides added rigidity to the machine framework. The shafts 19 and 20 are geared together for turning in opposite directions by spur gears 31 and 32 having equal numbers of teeth, and a hand wheel 33 on the shaft 19 enables adjustment for manual positioning of the die roll assemblages 17 and 18. The lower shaft 20 has a grooved pulley 34 to accommodate a V-belt 35 for supplying power to the shafts 19 and 20. The degree of mesh of the spur gears 31, 32 is adjusted by the nut and screw assemblage 29 in cooperation with the associated adjusting screw 26 and lock nut 27. The spacing between the die roll assemblage 17 and 18 can be varied by adjustment of the associated screw 26 in conjunction with the compression spring 28.

Figure 20:
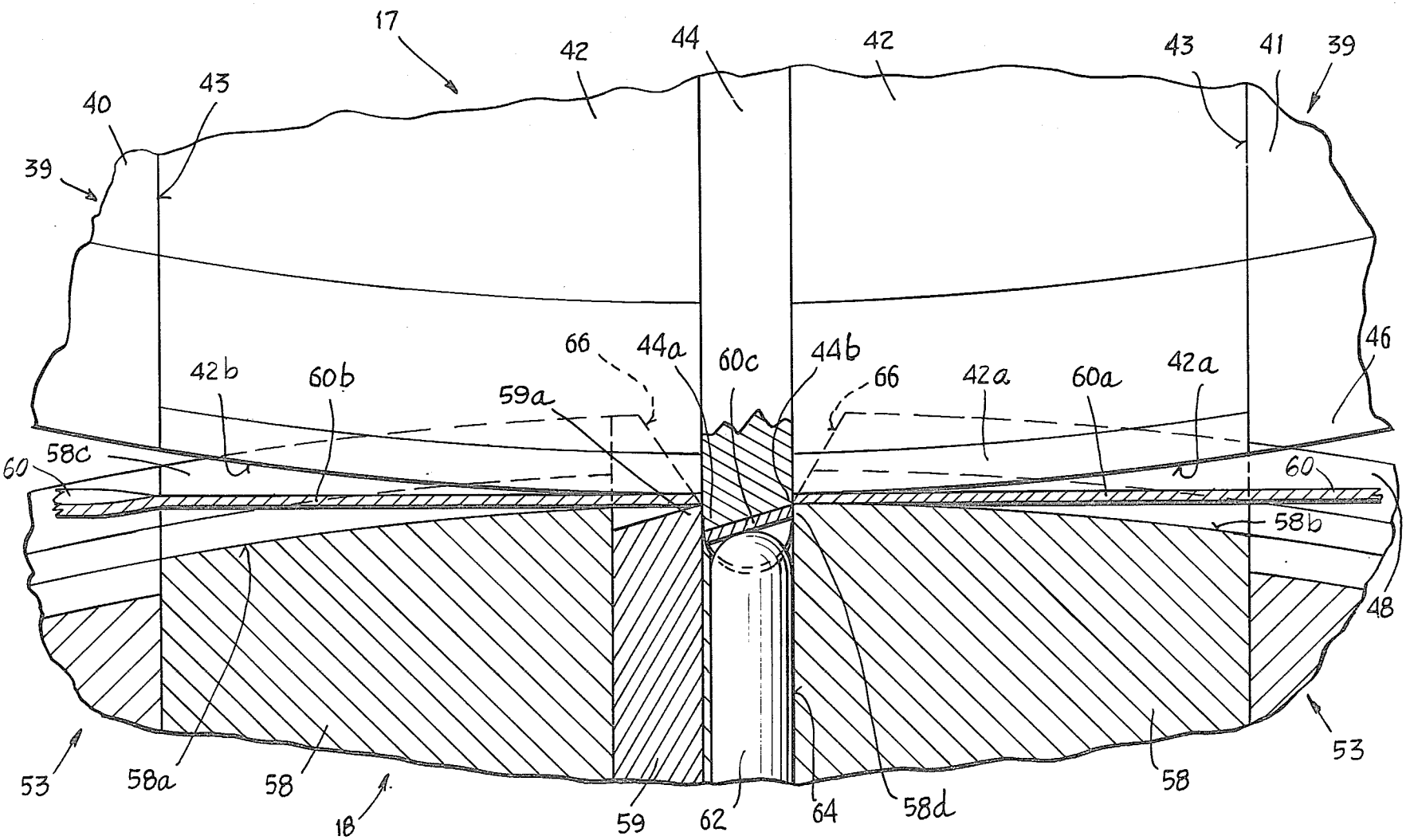
FIG. 20 is a greatly enlarged, fragmentary detail partly in end elevation and partly in vertical section, of the die rolls and cooperable cutting bits shown in the process of blanking out a portion of the grooved ribbon.
Figure 21:
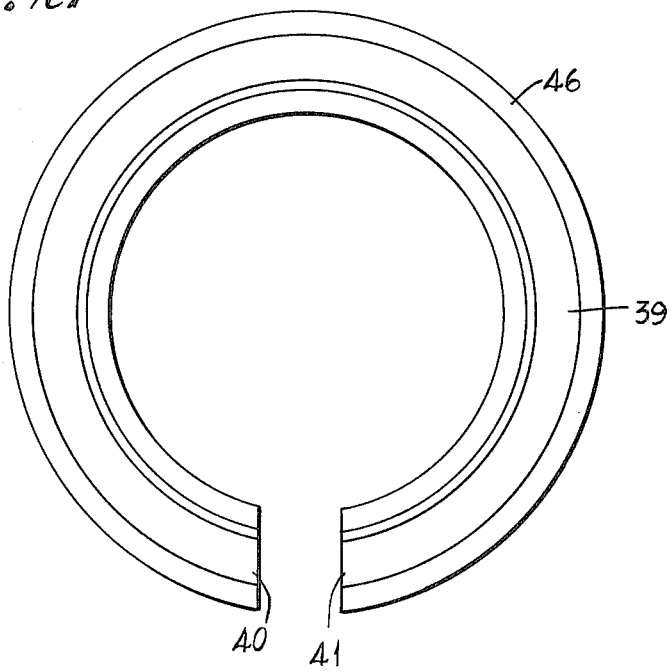
FIG. 21 is a side elevational view of the male die roll element, having the form of a discontinuous ring.
Figure 22:
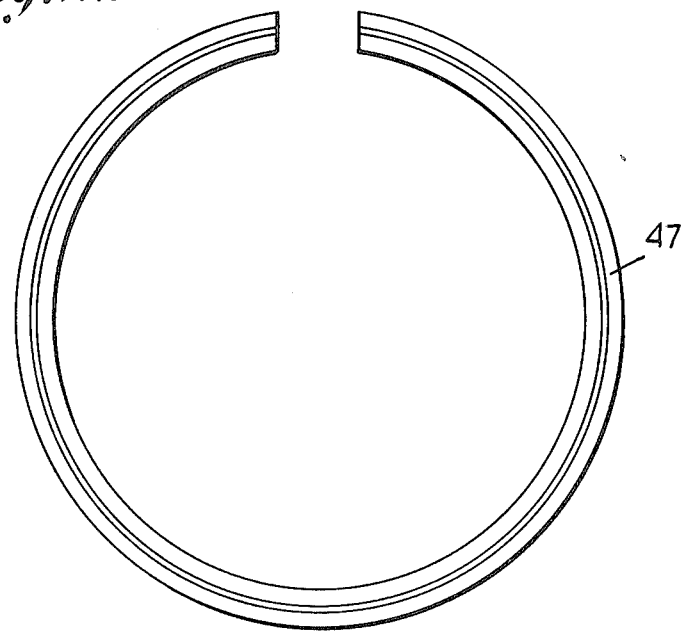
FIG. 22 is a side elevational view of the female die roll element, also in the form of a discontinuous ring.

Referring now to FIGS. 1, 3 and 5-9 the male die roll assemblage 17 comprises a hub 37 having secured to it a circular body portion in the form of an annulus or roll body 38 which carries an abrasion-resistant male roll element 39 in the form of a discontinuous ring that has been cut through to provide facing end portions 40 and 41 (FIG. 20). Disposed in the gap or cut between the end portions 40, 41 of the roll element 39 is a tool bit holder 42 which is also accommodated in a peripheral cut or recess 43 in the roll body 38. The tool bit holder 42 has a slot 42*d* whereby it receives and mounts a shearing bit or flat cutter piece 44, which can be thought of in general terms as disposed in the cuts of the element 39 and body 38 and which is secured in place by a clamping set screw 45. The tool bit holder 42 also functions as a ribbon feed means or piece, as will be later brought out.

Figure 19:
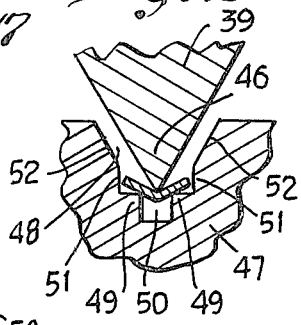
FIG. 19 is a fragmentary sectional view taken on the line 19—19 of FIG. 3.

The die roll element 39 has the general form of a flat, discontinuous annulus, with a tapered or V-shaped outer peripheral portion 46. The element 39 may be considered as a circumferentially extending peripheral portion, of wedge-shaped cross-sectional configuration, of the roll assemblage 17. For cooperation with the peripheral portion 46 of the male roll element there is provided a circular, discontinuous ring-shaped or cut, grooved female roll element 47 having in its outer periphery an annular groove 48 with a cross-section as indicated in FIG. 19. The groove 48 has ribbon-guiding or positioning means in the form of a pair of annular shoulders 49 separated by a central annular clearance space 50, and has side walls 51 meeting the shoulders 49 and also joining angular walls 52 which extend to the mouth of the groove. The female roll element 47 is carried by a notched or recessed roll body 53 mounted on a hub 54 which is affixed to the shaft 20.

The roll elements 39 and 47 are removably secured to the respective roll bodies 38 and 53 by clamping means in the form of flat rings 55 and 56 respectively, with cap-screws as shown. The flat clamping ring 55 also secures in place the cutting bit holder 42. A clamping plate 57, FIGS. 3 and 5, secures in place a cutting bit holder 58 having a slot 58*d* and a clamping screw 58*a* which latter clamps a bit 59 that is cooperable with the cutting bit 44 to sever the flat resistance wire or ribbon stock, such stock being designated by the numeral 60.

Figure 6:
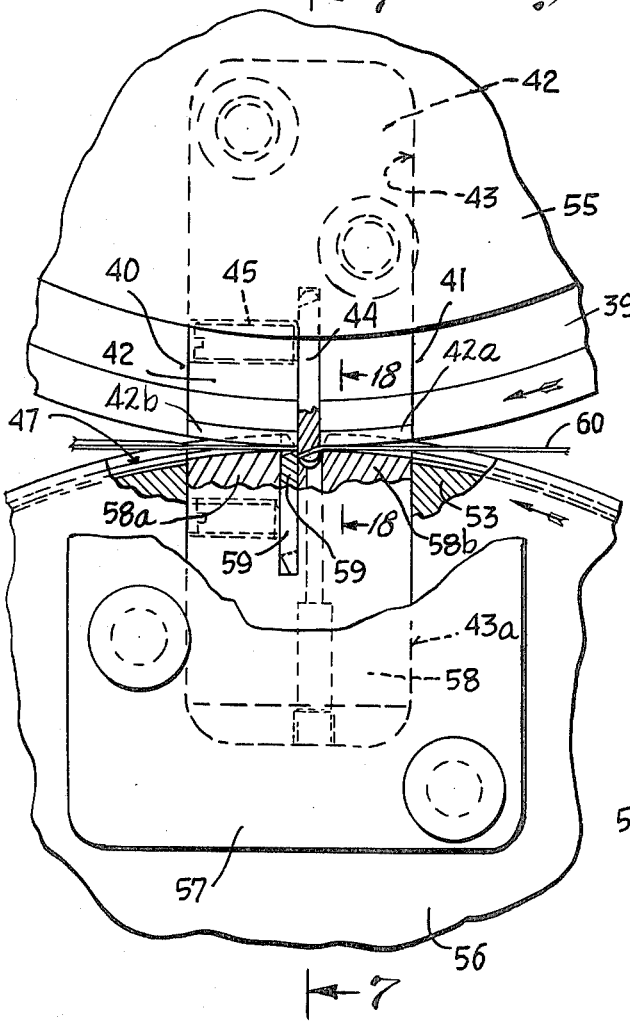
FIG. 6 is a detail, enlarged, of portions of FIG. 5, showing in section certain interior structures.
Figure 7:
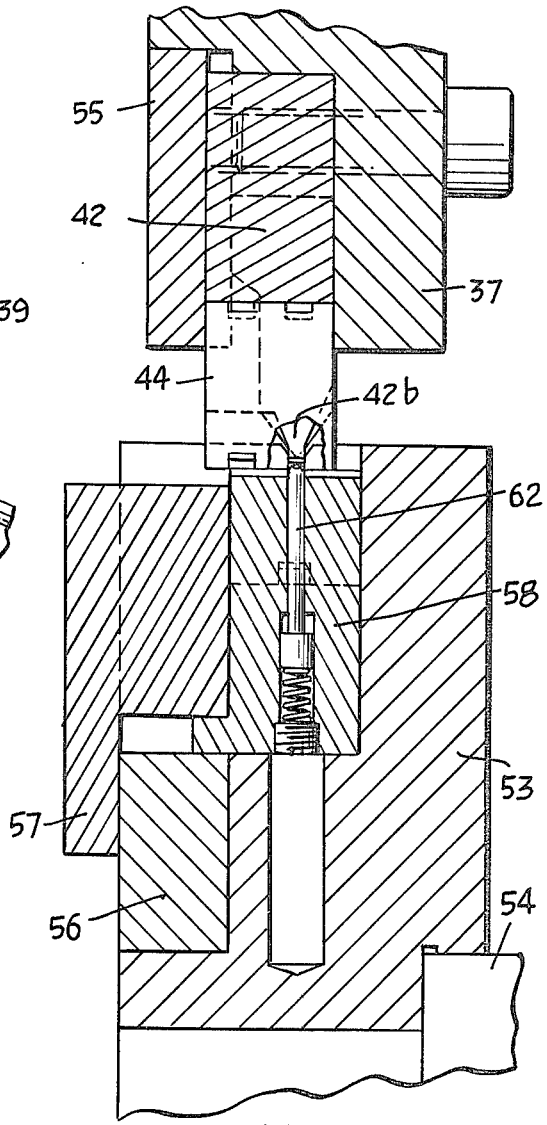
FIG. 7 is a fragmentary vertical section, taken on the line 7—7 of FIG. 6.
Figure 9:
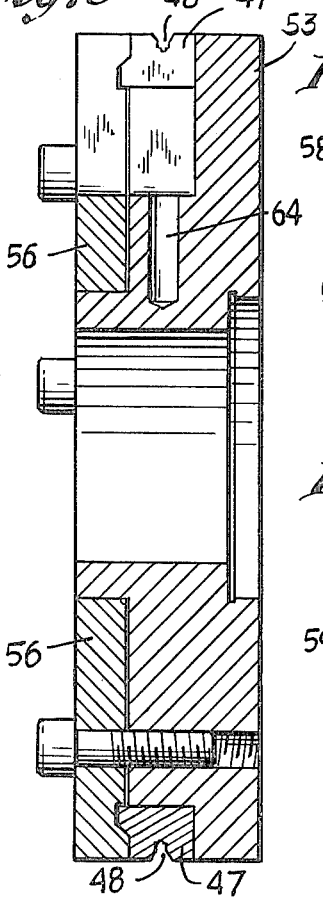
FIG. 9 is a vertical section of the female die roll, shown in the position of FIGS. 5 and 6.
Figure 14:
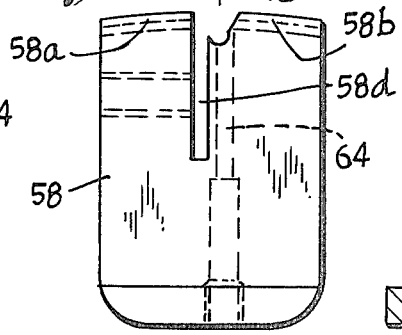
FIG. 14 is a face elevational view of the cutting bit holder for the female die roll.
Figure 15:
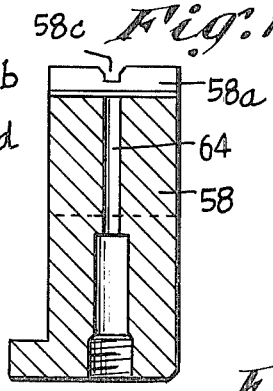
FIG. 15 is a section taken on line 15—15 of FIG. 14.
Figure 16:
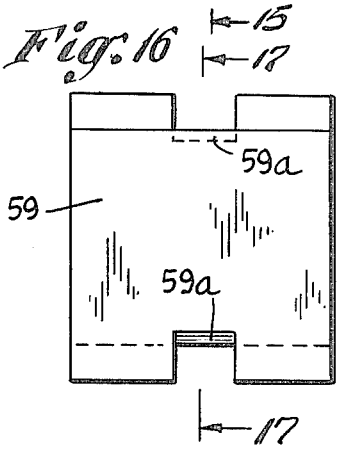
FIG. 16 is a face elevational view of the cutting bit for the holder of FIGS. 14 and 15.
Figure 17:
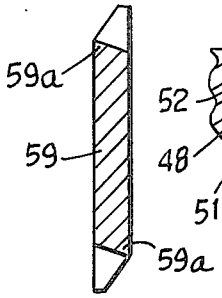
FIG. 17 is a section taken on the line 17—17 of FIG. 16.

Referring to FIGS. 9 and 19 it will be seen that the annular groove 48 in the female roll element 47 snugly accommodates the ribbon 60 between the shoulders 51. The ribbon, in this position, spans the annular clearance space 50 of the groove 48. The die roll assemblages 17 and 18 are so positioned that the tapered periphery 46 of the male assemblage will engage and impart a force against one side of the ribbon, which is opposed by supporting forces that are supplied by the shoulders 49 of the female die roll 18, acting on the other side of the ribbon adjacent the longitudinal edges thereof. In consequence, the ribbon 60 will be forced partly into the clearance space 50, and will have imparted to it a V-shaped cross-sectional configuration. This forming occurs, however, only after a flat portion of the ribbon has passed between the ribbon feed pieces or bit holders 42 and 58 and has been severed by the cutting bits 44 and 59, as illustrated in FIGS. 6 and 20. In FIG. 20 the leading, flat end portion of the ribbon 60 is designated by the number 60*a*, and it will be seen that the tapered periphery 46 of the male die roll assemblage 17 is about to engage the ribbon at the point of commencement of its entry in the groove 48 of the female die roll assemblage 18. From the positions of FIGS. 6 and 20, the roll assemblages rotate, after a cut-off has been effected of the ribbon portion designated 60*b* in FIG. 20, and progress as indicated by the arrows in FIG. 3. The grooving of the ribbon 60 thus continues until a revolution of each of the die assemblages has occured, whereupon the starting positions of FIGS. 6 and 20 will be attained wherein another severence of the ribbon occurs in the flat portions 60*a*, 60*b*.

The cutting bits 44 and 59 have sharp cutting edges 44*a* and 59*a* respectively, to enable them to shear the ribbon; also, the bit 44 of the male die roll has a shearing edge 44*b* which engages the ribbon 60 adjacent the point of the first severence, and which is cooperable with a shearing edge 58*d* of the bit holder 58 to effect the blanking out of a short section 60*c* of the ribbon 60 as seen in FIG. 20.

Upon continued turning of the die roll assemblages 17 and 18, a spring-biased ejecter means in the form of a pin 62 carried in a bore 64 of the bit holder 58 ejects the blanked-out portion 60*c*, once each revolution.

The die roll assemblages 17 and 18 can turn continuously, and need not be halted at any time after commencement of the operation. The flat ribbon 60 is fed continuously to and between the roll assemblages, and the diameters of these latter are so chosen as to produce, for each of their revolutions, a predetermined given length of resistance ribbon having between the flat end portions 60*a*, 60*b* a grooved or ribbed intermediate portion. The gears 31 and 32 can be chosen and adjusted for virtually no backlash, whereby they effect precise synchronized opposite turning movements of the die roll assemblages 17 and 18.

Figure 10:
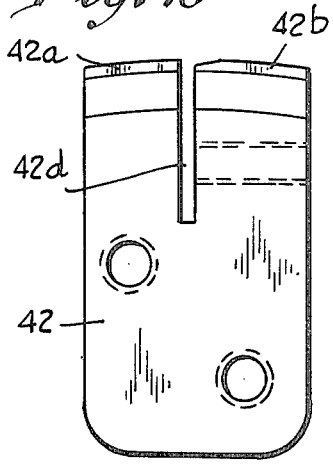
FIG. 10 is a face elevational view of the cutting bit holder for the male die roll.
Figure 11:
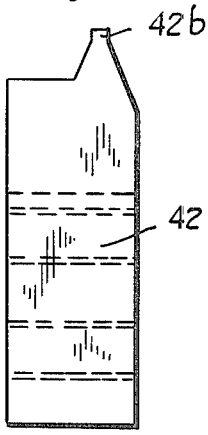
FIG. 11 is an edge elevational view of the bit holder of FIG. 10.
Figure 12:
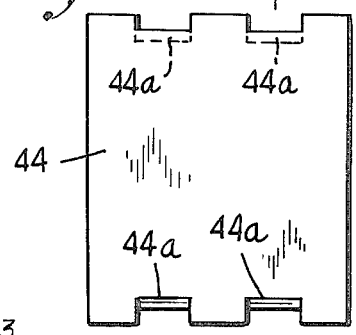
FIG. 12 is a face elevational view of the cutting bit for the holder of FIGS. 10 and 11.
Figure 13:
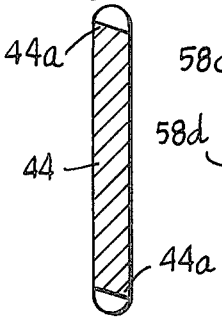
FIG. 13 is a section taken on the line 13—13 of FIG. 12.
Figure 18:
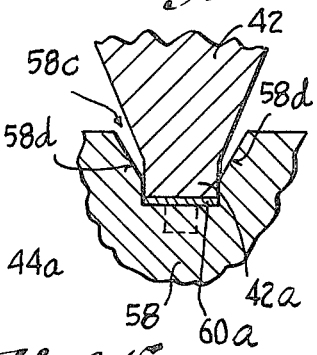
FIG. 18 is a fragmentary sectional view taken on the line 18—18 of FIG. 6.

Referring to FIGS. 10 and 11 it will be seen that the bit holder 42 has raised ribbon-feed portions or lands 42*a* and 42*b* which are adapted to engage the flat-configured portions of the ribbon 60. Likewise, the bit holder 58 of the female die roll assemblage has raised ribbon-feed portions or lands 58*a* and 58*b* provided with grooves 58*c* adapted to receive the lands 42*a*, 42*b* of the bit holder 42 as well as the flat ribbon, this for the purpose of frictionally gripping and feeding the latter to insure its advance between the roll assemblages, without slippage. The ribbon-feed portions are provided on opposite sides of the slots for the cutting bits; that is, they are both ahead of and trailing the cutting bits. Thus, feed occurs both before and after severance of the ribbon 60. Referring to FIGS. 10, 11, 14 and 15, it will be seen that the feed portions 42*a*, 42*b* are in the form of wedges or tongues, receivable in grooves 58*c* of the feed portions 58*a*, 58*b*. A close fit is provided, as shown in FIG. 18, to insure proper friction feed and guidance for the ribbon 60 at the high production speeds employed; flat portions of the ribbon are engaged by the feed pieces or bit holders 42, 58 as can now be understood. The close fit also helps to maintain the accurate axial orientation of the die rolls. The grooves 58*c* have sloped or tapering wall portions 58*d* which insure that the ribbon 60 is guided laterally, before and after severence, to the center of the grooves. The ribbon feed portions 42*a*, 42*b*, 58*a* and 58*b* are understood to be located in the cuts or notches 43, 43*a* of the die rolls.

The severing of the ribbon 60 occurs after the cessation in the imparting of the ribbing forces and prior to resumption of the ribbing forces, in flat areas of predetermined length, of the ribbon. These flat areas correspond to a small fractional part of a revolution of the die roll assemblages.

The cutting bits 44 and 59 are arranged to have a symmetrical configuration with multiple cutting edges 44*a* and 59*a* as shown, whereby the bits can be reversibly inserted in the holders after a cutting edge has become worn, to present a new cutting edge for engagement with the ribbon.

Those parts which are subjected to wear, such as the cutting bits 44 and 59, the bit holder 58 and the male and female roll elements 19 and 47 are made of special alloys and/or hardened, to minimize the effects of abrasion.

The bearings 21 and 22 for the shafts 19 and 20 are sturdily and precisely constructed to provide for exact positioning of the die roll assemblages 17 and 18, this being also true of the stanchions 11, 12 and cross beam 30. A fine adjustment of the relative positions of the roll assemblages 17 and 18 is had by virtue of the spring-biased slide block 23 and adjusting screw 26 with lock nut 27.

It will be understood that the spur gears 31 and 32 insure precisely synchronized, opposite turning of the die roll assemblages 17 and 18, and guarantee the proper cooperable relationship between the cutting bits 42 and 59, as well as between the bit 42 and holder block 58 for the bit 59.

As provided by the invention, the cutting bit holders 42 and 58 have feed surfaces 42*a*, 42*b* and 58*a*, 58*b* and act as feeding pieces or components, pressing against the flat ribbon portions 60*a*, 60*b* and frictionally seizing the same to render the cutting of the blank 60*c* effective at always precisely the same spot whereby each cut length of the formed resistance ribbon is accurate to the desired dimension, with the flat end portions 60*a*, 60*b* thereof precisely oriented with respect to the grooved intermediate portions. A secure, frictional seizing of the ribbon is effected by the bit holders 42 and 58, for this purpose. The bit holder 58 is cut away as indicated at the locations 66 to provide the required clearance for accommodating the angular path of travel of the cutting bit 44 as it approaches and withdraws from the cutting bit holder 58.

It can now be seen that the present method and apparatus operate with extreme rapidity, since the ribbon is pulled between the roll assemblages and processed to be grooved and cut into lengths virtually as rapidly as if the ribbon were to travel between the rolls without any operations whatsoever being performed on it.

The ribbon is of small width, and can be on the order of 1/16th of an inch wide, with a thickness on the order of 0.010". With such a small width it will be understood that a very precise support and control of the ribbon must be had at all times, in order that the V-groove becomes symmetrically placed, in addition to its orientation with respect to the flat ends. I have found that the present method and apparatus as above illustrated and described provide formed lengths of resistance wire ribbon at high production rates and with great uniformity and exceptional quality. As a consequence, ribbon strips made in accordance with the invention can be utilized with great success in automatic spiral-coiling machinery, to produce spirally wound heating coils of high quality.

Each and every one of the appended claims defines a distinct aspect of the invention separate from the others, and each claim is accordingly to be treated in this manner when the prior art devices are examined in any determination of novelty or validity.

Variations and modifications are possible without departing from the spirit of the invention.

I claim:

1. High-production apparatus for processing flat, resistance-wire ribbon stock in preparation for making the same into a spiral heating coil, comprising in combination:

(a) a pair of cooperable male and female die rolls,
(b) one of said die rolls having a circumferentially extending peripheral portion characterized by a wedge-shaped cross-sectional configuration,
(c) the other of said die rolls having a circumferentially-extending peripheral portion provided with an annular circumferential groove adapted to receive the peripheral portion of the first die roll,
(d) means on said other die roll, providing guides in said annular groove for engagement with the resistance-wire ribbon stock,
(e) said guide means positioning the ribbon to enable the peripheral portions of said first die roll to engage one side of the ribbon along a longitudinal area spaced inwardly from the longitudinal side edges of the ribbon,
(f) said other die roll having an annular clearance space in the groove thereof, located between said guide means and nearer to the center of the die roll, for providing clearance at a side opposite said one side of the resistance-wire ribbon to enable central portions of the ribbon to be forced into said clearance space by force imparted thereto by the peripheral portion of the first die roll.

2. A high-production apparatus as defined in claim 1, wherein:

(a) the peripheral portion of the first-mentioned die roll, which is characterized by the wedge-shaped cross section, is discontinuous, having a cut in it,
(b) a ribbon-feed piece disposed in the cut of the first-mentioned die roll,
(c) said peripheral portion of the other die roll being discontinuous and having a cut in it, and
(d) a ribbon-feed piece disposed in the cut of the second-mentioned die roll and cooperable with the ribbon-feed piece of the first-mentioned die roll to grip the resistance-wire ribbon and advance the same between the die rolls.

3. A high-production apparatus as defined in claim 2, and further including:

(a) cooperable ribbon-shearing bits in the cuts of the die rolls, for severing a grooved portion of the ribbon from the remainder of the flat stock.

4. A high-production apparatus as defined in claim 1, and further including:

(a) cooperable means carried by the die rolls, for severing a grooved portion of the ribbon from the remainder of the flat stock once for each revolution of the die rolls.

5. A high-production apparatus as defined in claim 4, and further including:

(a) means on the die rolls, for severing the ribbon stock adjacent the line of severance of said cooperable means whereby a small portion of the stock is blanked out.

6. A high-production apparatus as defined in claim 5, and further including:

(a) means on one die roll for ejecting the blanked-out portion of the ribbon stock.

7. A high-production apparatus as defined in claim 6, wherein:

(a) said ejector means comprises an ejector pin on one die roll, and
(b) means biasing said pin to an extended, ejecting position on the die roll.

8. A high-production apparatus as defined in claim 3, and further including:

(a) bit holders disposed in the cuts of the die rolls,
(b) said shearing bits comprising flat cutter pieces,
(c) said bit holders having slots in which the cutter pieces are carried.

9. A high-production apparatus as defined in claim 8, wherein:

(a) said cutter pieces have opposite ends provided with cutting edges,
(b) said cutter pieces being reversible in the slots of the bit holders to enable a ready substitution of a fresh cutting edge for a worn cutting edge to be effected.

10. A high-production apparatus as defined in claim 2, wherein:

(a) the ribbon-feed piece in the cut of the second-mentioned die roll has a groove in which the first-mentioned die roll is received, and which guides the said ribbon stock.

11. A high-production apparatus as defined in claim 10, wherein:

(a) the groove in the said ribbon-feed piece has tapered side walls,
(b) said other ribbon-feed piece having a wedge-shaped cross-sectional portion received in said groove.

12. A high-production apparatus as defined in claim 8, wherein:

(a) the bit holders have ribbon-feed portions on opposite sides of the slots thereof, engageable with and adapted to feed said flat ribbon stock.

13. A high-production apparatus as defined in claim 12, wherein:

(a) the ribbon-feed portions of the bit holders comprise cooperable tongue and groove formations,
(b) said groove formations being adapted to receive and guide said flat ribbon stock.

14. A high-production apparatus as defined in claim 7, wherein:

(a) the die rolls have bit holders disposed in the cuts thereof,
(b) one of said bit holders having a recess to receive a portion of a bit carried by the other bit holder,
(c) said ejector pin being adapted to extend into said recess under the action of the biasing means therefor.

15. A high-production apparatus as defined in claim 1, wherein:

(a) the said peripheral portions of the die rolls comprise abrasion-resistant rings, (b) said die rolls comprising circular body portions, and (c) clamping means removably securing the abrasion-resistant rings to the body portions.

16. A high-production apparatus as defined in claim 10, wherein:

(a) the groove in said ribbon-feed piece has tapered side wall portions adapted to maintain the ribbon stock centralized in said groove.

17. A high-production apparatus as defined in claim 1, and further including:

(a) means for effecting concurrent, synchronized opposite turning movements of said die rolls.

18. A high-production apparatus as defined in claim 13, wherein:

(a) said cooperable tongue and groove formations closely fit each other to effect a precise axial orientation of the die rolls.

* * * * *